United States Patent [19]

Salvarezza

[11] 4,177,878

[45] Dec. 11, 1979

[54] ROPE LADDER

[76] Inventor: Robert M. Salvarezza, 110 Braemar Dr., Hillsborough, Calif. 94010

[21] Appl. No.: 933,645

[22] Filed: Aug. 14, 1978

Related U.S. Application Data

[63] Continuation-in-part of Ser. No. 901,785, May 1, 1978.

[51] Int. Cl.[2] ..... E06C 1/56; E06C 7/50

[52] U.S. Cl. ..... 182/199; 182/228

[58] Field of Search ..... 182/199, 198, 197, 196, 182/70–75, 228

[56] References Cited

U.S. PATENT DOCUMENTS

| | | | |
|---|---|---|---|
| 800,934 | 10/1905 | McArthur | 182/199 |
| 3,415,341 | 12/1968 | Hostetler | 182/199 |

FOREIGN PATENT DOCUMENTS

| | | | |
|---|---|---|---|
| 43380 | 10/1938 | Netherlands | 182/196 |
| 211492 | 3/1967 | Sweden | 182/196 |
| 1036816 | 7/1966 | United Kingdom | 182/198 |

*Primary Examiner*—Reinaldo P. Machado
*Attorney, Agent, or Firm*—Owen, Wickersham & Erickson

[57] ABSTRACT

A rope ladder in which a pair of bolted-together wedge collars and a wedge heart act upon a pair of ropes at each side of each step, to wedge themselves to the rope so that they and their step are locked firmly in place, relative to the rope.

12 Claims, 14 Drawing Figures

FIG. 1
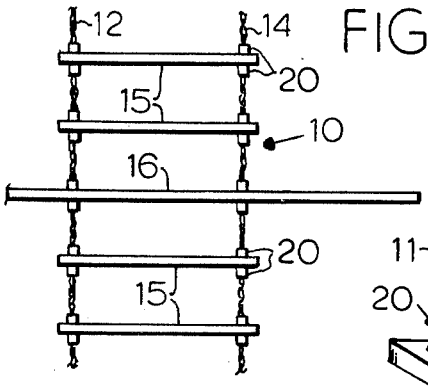
FIG. 2
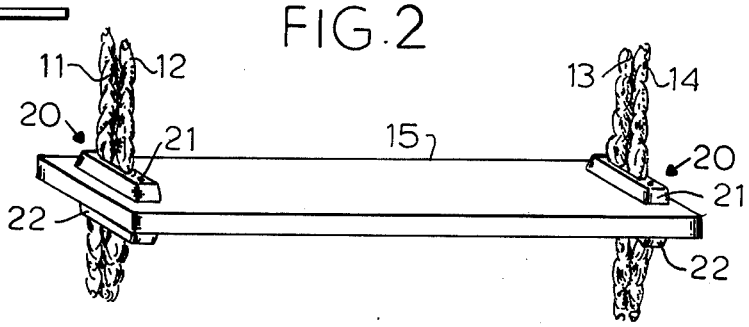
FIG. 5
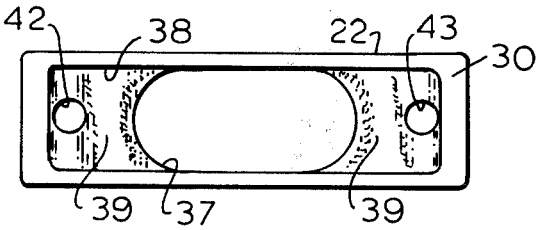
FIG. 3
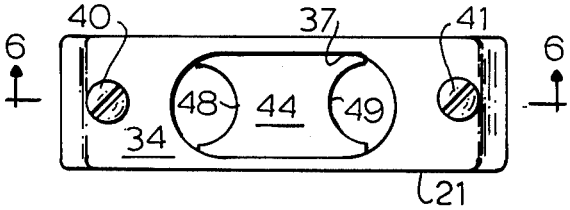
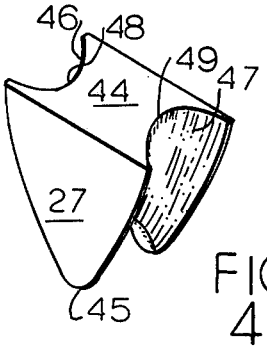
FIG. 4
FIG. 6
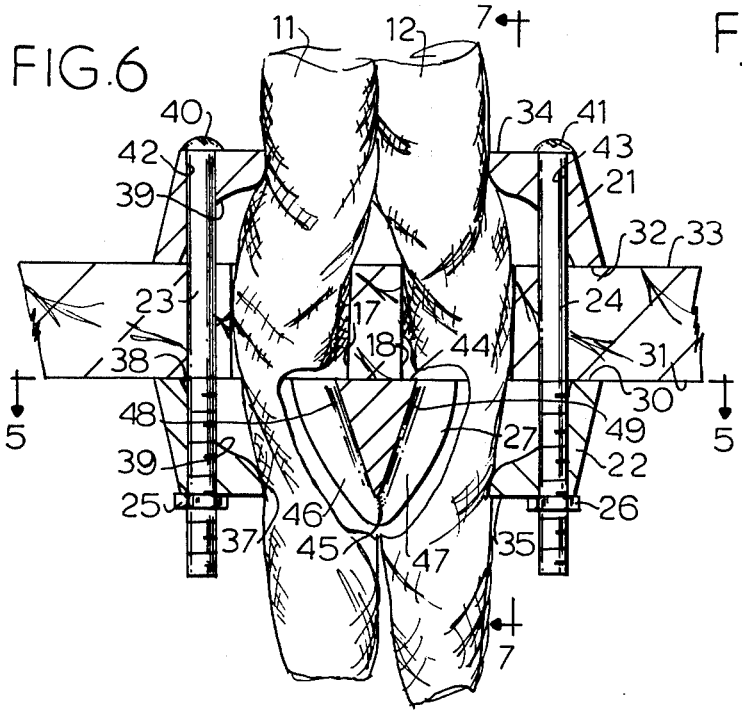
FIG. 7
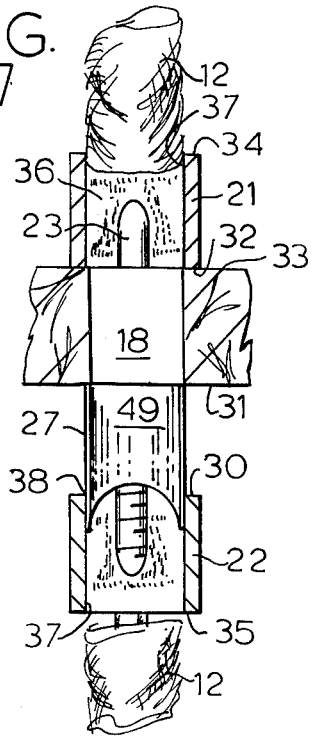

FIG. 8
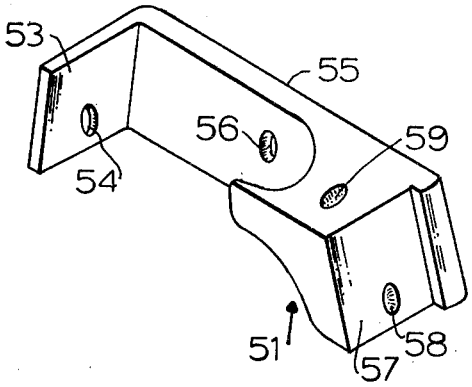
FIG. 9
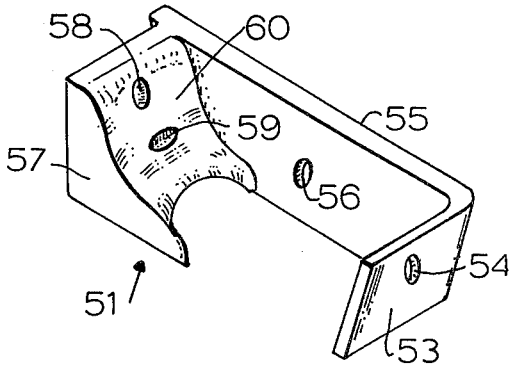
FIG. 10
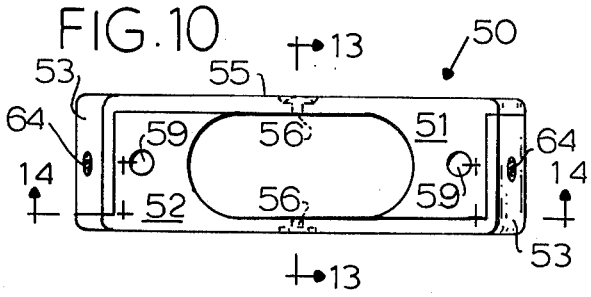
FIG. 12
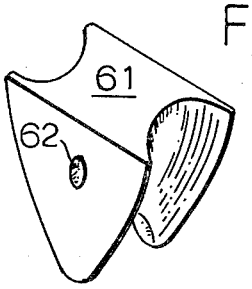
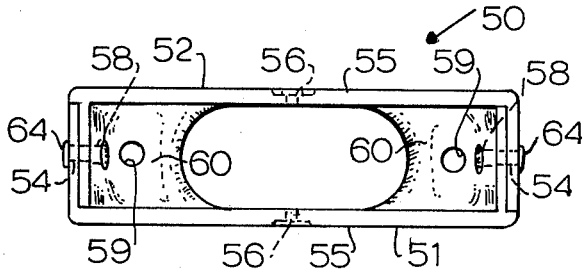
FIG. 11
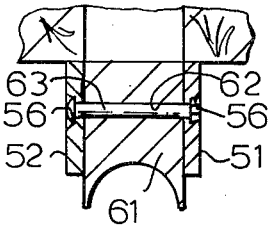
FIG. 13
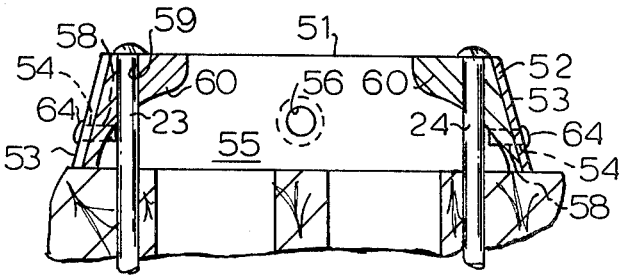
FIG. 14

ROPE LADDER

REFERENCE TO RELATED APPLICATION

This application is a continuation-in-part of application Ser. No. 901,785, filed May 1, 1978.

BACKGROUND OF THE INVENTION

This invention relates to an improved rope ladder.

Rope ladders can be used for many purposes, such as emergency escapes from buildings and so on, but a leading use is for embarcation and debarcation of vessels, such as merchant vessels, especially by pilots. Since the risks involved are large when pilots use these ladders at sea, they must be made very safe, and the U.S. Coast Guard has rigid specifications which must be met by them.

Heretofore, in order to meet the high standards of the U.S. Coast Guard, rope ladders have been made very slowly by hand. Four ropes have been used for each ladder, arranged in two pairs. Above and below each step the ropes of each pair have been tied together by hand. Even so, this method of making rope ladders has not proven foolproof and weaknesses have developed; for example, the ties may fray or be cut, as is not unlikely when the rope ladder is used on a pitching and tossing ship.

An object of the present invention is to provide a safer and more reliable rope ladder meeting the standards of the U.S. Coast Guard.

Another object of the invention is to provide a rope ladder which even though superior to those in use, can be made less expensively, and therefore can be made less expensively than can rope ladders presently approved by the U.S. Coast Guard.

Another object of the invention is to provide a rope ladder incorporating metal parts that exert a wedging action that secures the steps to the ropes.

Another object of the invention is to provide metal replacement parts for the rope ladder of this invention.

Other objects and advantages of the invention will become apparent from the description of the invention.

SUMMARY OF THE INVENTION

The rope ladder of the present invention is adapted for U.S. Coast Guard approval and, like earlier approved ladders has two pairs of ropes, one pair adjacent each end of each of the series of steps. The steps are normally rectangular and flat, each with an upper surface and a lower surface, with two longitudinal edges and two transverse end edges. As in currently approved ladders, each step has two spaced-apart pairs of vertical through openings, one pair near each end of the step, spaced in from the end edge. Each opening of the pair is spaced apart from the other one, and they are aligned parallel to the adjacent transverse or end edge. Each rope passes through a separate opening and substantially fills that opening.

The present invention provides two pairs of wedge collars which can be made of any suitable rigid material but are preferably lightweight but strong metal. There is an upper wedge collar and a lower wedge collar at each end of each step, the upper wedge collar being above the step with its lower surface resting against the upper surface of the step, while the lower wedge collar is below the step and its upper surface, when the ladder is completed, is preferably in engagement with the lower surface of the step.

Each wedge collar has a step-engaging end and a distal end, and a single elongated through opening extends vertically through the wedge collar; through this opening the pair of ropes passes. This single elongated through opening is wider at the step-engaging end than the overall distance between and including the through openings of the step. The through opening of at least the lower wedge collar—and the two collars may be made identical as a money saving expedient—is sloped or curved inwardly from the step-engaging end to a narrower portion at the distal end. This narrower portion of the opening is barely wide enough for the two ropes to pass through side-by-side. The wedge collars also have matching passages for bolts through them, preferably for two bolts.

A wedge heart is placed in between the two ropes of each pair of ropes in the elongated through opening of each lower wedge collar. The wedge heart has an upper surface for engagement with the lower surface of the step. The wedge heart tapers downwardly and inwardly from its upper surface to an apex at its lower end, and provides two rounded concave rope-engaging side surfaces ending at the apex. At the upper surface, these surfaces are spaced apart a distance identical to the distance between the through openings of the step. Thus, the rope follows the convex surfaces of the wedge heart.

When the wedge collars are fully tightened together by a pair of bolts, each with its nut, the wedge heart and wedge collars act to clamp themselves to the rope, and the wedge action is such that the rope is locked immovably between the lower wedge collar and the wedge heart, so that the rope cannot move relatively to them. Since the upper wedge collar is clamped firmly to the lower wedge collar by the bolts and nuts, the step is also clamped in place, so that the step is held firmly in position and cannot move relatively to the rope.

For replacement of broken parts without having to disassemble the rope ladder and rethread the steps and metal parts thereon, the invention also provides slot-entry steps and wedge collars made in two pieces each, with a bolt enabling their installation.

Further understanding of the principles of the invention will be obtained from a detailed description of a preferred example, as shown in the drawings.

BRIEF DESCRIPTION OF THE DRAWINGS

In the drawings:

FIG. 1 is a view in front elevation of a rope ladder embodying the principles of the invention. On one side an extended step is broken off to conserve space.

FIG. 2 is a fragmentary isometric view of a single step of the ladder of FIG. 1, held by two pairs of ropes, two pairs of wedge collars, and two wedge hearts.

FIG. 3 is a top plan view of the two wedge collars with the wedge heart in the bottom collar.

FIG. 4 is a view in perspective of the wedge heart.

FIG. 5 is a top plan view of the lower wedge collar.

FIG. 6 is a view in section taken along the line 6—6 in FIG. 3 but also showing the rope and step in place, with portions of the rope broken away where the breaking away makes the view clearer.

FIG. 7 is a view taken at right angles to FIG. 6 with the parts being shown prior to complete assembly, the lower wedge collar being shown well below its final position.

FIG. 8 is a view in perspective of one of two identical elements used in a replacement-type wedge collar.

FIG. 9 is another perspective view of the same member looking at it from a different viewpoint.

FIG. 10 is a top plan view of a wedge collar assembly made up of two members like that of FIGS. 8 and 9.

FIG. 11 is a bottom view of the same wedge collar assembly.

FIG. 12 is a view in perspective of a wedge heart for use in conjunction with the two-piece wedge collar of FIGS. 8—11.

FIG. 13 is a view in section taken along the line 13—13 in FIG. 10.

FIG. 14 is a view in section taken along the line 14—14 in FIG. 10, with a portion of one step shown.

DESCRIPTION OF A PREFERRED EMBODIMENT

FIG. 1 shows a rope ladder 10 embodying the principles of the invention. This rope ladder 10 has four ropes in two pairs, namely, a pair of ropes 11 and 12 at one side, and a pair of ropes 13 and 14 at the other side of the ladder 10. Each of these ropes 11, 12, 13, 14 passes through and is anchored to a series of steps 15 by the means of the present invention. At suitable and prescribed intervals is an elongated step 16, which is the same as the steps 15 except that it extends well out beyond the ropes and helps to keep the rope ladder 10 from turning or twisting relative to the ship. This is all prescribed by U.S. Coast Guard regulations and is standard practice. At each step the ropes 11,12, and 13, 14 pass through the step 15 or 16 by means of separated openings 17 and 18. The ropes 11, 12 and 13, 14 are held in place at each side of each step 15, 16 by an assembly 20 embodying the principles of this invention.

FIG. 2 shows a single step 15 with its two assemblies 20 securing the step 15 to its four ropes 11, 12 and 13, 14.

As can be seen in FIGS. 3 through 7, each assembly 20 comprises an upper wedge collar 21, a lower wedge collar 22, a pair of bolts 23 and 24 with their nuts 25 and 26, and a wedge heart 27. These are the only pieces required for each assembly 20, two assemblies 20 being used for each step.

The two wedge collars 21 and 22 may be identical although they need not be. Certain features which are critical to the lower wedge collar 21 are useful in the upper wedge collar 22, but need not necessarily be present there. Thus, the lower wedge collar 22 has an upper surface 30 which is preferably in snug engagement with the lower surface 31 of the step 15 or 16 when the assembly 20 is fully installed. This is not completely necessary and the operation may end up with a slight space between the surfaces 30 and 31, but preferably they are in engagement at that time. Similarly, the upper wedge collar 21 has a lower surface 32 in engagement with the upper surface 33 of the step 15 or 16. This will be true in all cases. The upper wedge collar 21 has an upper surface 34 and the lower wedge collar 22 has a lower surface 35, each of which may be considered a distal surface relative to the step 15.

Each wedge collar 21 and 22 has an elongated through opening 36, and when the two collars 21 and 22 are identical, as is shown in the drawings, this preferably takes the shape of the through opening 36. At the lower end 35 of the lower wedge collar 22, this through opening has a portion 37 which is barely wide enough for the two ropes 11, 12 (or 13, 14) to pass through in side-by-side relationship snugly against each other. This may also be true and is desirably true with the upper wedge collar 21, though it is not necessary. At the upper surface 30 of the lower wedge collar 22, the opening 36 has a considerably wider portion 38, which is wider than the distance between the two openings 17 and 18 through the step 15 or 16. In between the two portions 37 and 38 there is preferably a curved tapering surface 39.

The distal surface 34 and 35 of each wedge collar 21, 22 provides a bearing surface for the two bolts 23, 24 and the nuts 25, 26. The heads 40, 41 of the bolts 23, 24 are usually placed to bear against the upper surface member 34, but that is not essential. The bolts 23, 24 are inserted through vertical passageways 42, 43, projecting out beyond a lower distal surface 35. When the nuts 25, 26 are threaded on the bolts and tightened, respectively, to their bolts 23, 24, they force the two wedge collars 21, 22 toward each other and snugly against the step 15 or 16. The bolt passageways 42, 43 may open into the openings 36 as shown, or they may be separate passages altogether.

In addition to the wedge collars 21, 22 there is, as stated, a very important wedge heart 27. This member 27 has a flat upper surface 44 which converges downwardly in a taper to an apex 45. Its two sides 46, 47 are intended to engage the ropes 11, 12 or 13, 14 and for that reason have rope-engaging concave arcuate surfaces 48 and 49 which follow the tapering or wedge shape, so that the two ropes 11, 12 or 13, 14 are definitely held apart at the upper end 44 of the wedge heart 27 and are brought together at the apex 45 by the snugness of fit of the ropes 11, 12 or 13, 14 in the elongated narrow opening portion 37 through the lower wedge collar 22. No wedge heart is needed and usually none is used for the upper wedge collar 21, although of course one may be used if desired. It is so unnecessary that it would be a mere duplication of materials.

Assembly of the ladder 10 includes threading the ropes 11 and 12 (or 13,14) first through one of the wedge collars 21, 22 and then through the step 15 or 16 and then through the other wedge collar 22, 21 at each step. The wedge heart 27 is preferably in place in its lower wedge collar 22 at the time of threading, although it could be inserted later. After the wedge heart 27 has been inserted, it is brought up against the lower surface 31 of the step 15 or 16 and remains snugly against it thereafter. The two bolts 23, 24 are inserted through the two wedge collars 21 and 22, and the nuts 25 and 26 are threaded on them. After making sure that the step 15 or 16 is at the desired location, tightening proceeds. As the tightening continues, the lower wedge collar 22 rises closer and closer to the step 15 or 16 and, preferably, eventually engages the lower surface 31 of the step 15 or 16, although that is not completely essential. At any rate, this tightening action brings about cooperation between the wedge heart 27 and the lower wedge collar 22, which eventually seizes the ropes 11 and 12 so snugly that they cannot move relative to the wedge heart 27 and the lower wedge collar 22, and at that point the lower wedge collar 22 usually bears snugly against the step 15 or 16. Even if it is not, the step 15 or 16 is at the same time held between the wedge heart 27 and the upper wedge collar 21 so that it is fixed immovably to the ropes 11, 12 or 13, 14.

The invention is simple to practice, since the wedge heart 27 and wedge collars 21, 22 can be inexpensively molded from lightweight metal alloy or from plastic (or made from wood or other materials, if desired). The bolts can be standard bolts, and the ropes and step are those already in use.

If a step should break, or if one of the assemblies should break, or if one of the wedge collars should break, then replacement may involve disassembly and reassembly of the ladder, in order to thread the rope through the steps and collars. To avoid this, it is possible to make a two-piece wedge collar which (when used with a replacement-type wedge heart and some additional machine screws or bolts and nuts) enables replacement without having to unthread and rethread substantial portions of the ladder. Such a replacement wedge assembly is shown in FIGS. 8—14; if desired, it may also be used for original equipment.

A replacement wedge collar 50 as shown in FIGS. 10 and 11 is made of two identical members 51 and 52, the member 51 being illustrated in perspective in FIGS. 8 and 9. When the two members 51 and 52 are assembled together, as shown in FIGS. 10 and 11, they make a wedge collar 50 very closely resembling the wedge collar 21 or 22 of FIG. 2. Thus, the member 51 includes a planar end portion 53 having a bolt opening 54 therethrough and a side portion 55 having a bolt opening 56. An opposite end portion 57, having bolt openings 58 and 59 and an adjacent part of the portion 55, are configurated to provide a desired shaped portion 60 for forcing the rope around the wedge heart.

In assembly, with the step in place (a replacement step having a notch enabling insertion on the rope may be used) the two members 51 and 52 can be put around the rope, and a wedge heart 61 having a bolt opening 61 inserted. Then the assembly 50 may be secured together by a transverse machine screw 63 or bolt and nut combination, which is not used with the previously described single-piece wedge collar 21 or 22. With this assembly in place around the rope, the vertical screws 23 and 24 are used as before. End screws 64 are also used to secure the two members 51 and 52 together at their ends, and for this purpose each member 51, 52 may have suitable threaded receptacle or if necessary, a nut may be employed. The threading is better because it does not require insertion of an actual nut. The resultant combination is substantially that of the original; however, since the original is unitary, it has advantages, especially in a new ladder.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A rope ladder, including in combination:

(a) a series of ladder steps, each with an upper surface and a lower surface, two longitudinal edges and two end edges, each step having two spaced-apart pairs of vertical through openings, one pair spaced in from each said transverse edge, the openings in each pair being spaced apart from each other, (b) two spaced-apart pairs of ropes, each rope passing through one said through opening of each said step, (c) two pairs of wedge collars for each said step, one pair at each end of said step with an upper said wedge collar above its step and a lower said wedge collar below its step, each said wedge collar having a step-engaging end and a distal end and a single elongated through opening through which one pair of ropes pass and which at said step-engaging end is at least as wide as the overall distance between and including said step's through openings, said elongated through opening of at least said lower wedge collar curving inwardly from said step-engaging end to a narrower portion of said elongated opening at the distal end that is barely wide enough for the two ropes to pass therethrough, said pair of wedge collars having an elongated pair of vertical bolt passages through them, (d) a wedge heart in between said ropes of each pair of ropes and in each said elongated through opening of said lower wedge collar, said wedge heart having an upper surface in engagement with said lower surface of said step and tapering downwardly to an apex at its lower end and providing two rope-engaging side surfaces ending at said apex, which at said upper surface are spaced apart a distance identical to the distance between said step's through openings, so that these rope-engaging surfaces, when said wedge heart is fully wedged to place, lock their pair of ropes in place and prevent relative movement between them and said lower wedge collar and wedge heart, and (e) a pair of bolts, each with a nut, for each pair of wedge collars, to wedge said wedge heart and lock said ropes in fixed position relative to said wedge heart and said pair of wedge collars and therefore to the step between the wedge collars.

2. The rope ladder of claim 1 wherein said upper and lower wedge collars are identical.

3. The rope ladder of claim 1 wherein said wedge heart and wedge collars are made from lightweight metal.

4. The rope ladder of claim 1 wherein each said wedge collar is made in two pieces, enabling insertion directly on any said step after the ladder is already completed, said two pieces thereupon being secured together.

5. The rope ladder of claim 4 wherein said two pieces of each said wedge collar are identical to each other.

6. The rope ladder of claim 4 wherein said wedge collar has a through opening extending through it from side to side and is thereby enabled to be bolted to a said wedge collar.

7. A rope ladder, including in combination:

(a) a series of generally rectangular flat steps, each with an upper surface and a lower surface, two longitudinal edges and two transverse edges, each step having two spaced-apart pairs of vertical through openings, one pair spaced in from each said transverse edge, the openings in each pair being spaced apart from each other and aligned parallel to its adjacent transverse edge, (b) two spaced-apart pairs of ropes, each rope passing through and substantially filling one said through opening of each said step, (c) two pairs of wedge collars for each said step, one pair at each end of said step with an upper said wedge collar above its step and resting against its upper surface and a lower said wedge collar below its step and in engagement with its lower surface, each said wedge collar having a step-engaging end and a distal end and a single elongated through opening through which one pair of ropes pass and which at said step-engaging end is at least as wide as the overall distance between and including said step's through openings, said elongated through opening of at least said lower wedge collar curving inwardly from said step-engaging end to a narrower portion of said elongated opening at the distal end that is barely wide enough for the two ropes which pass therethrough when side-by-side, said pair of wedge collars having an elongated pair of vertical bolt passages through them, (d) a wedge heart in between said ropes of each pair of ropes and in each said elongated through opening of said lower wedge collar, said wedge heart having an upper surface in engagement with said lower surface of said step and tapering downwardly to an apex at its lower end and providing two rounded rope-engaging side surfaces ending at said apex, which at said upper surface are spaced apart a distance identical to the distance between said step's through openings, so that these rope-engaging surfaces, when said wedge heart is fully wedged to place, lock their pair of ropes in place and prevent relative movement between them and said lower wedge collar and wedge heart, and (e) a pair of bolts, each with a nut, for each pair of wedge collars, tightened so as to cause said wedge heart and both wedge collars of each pair to bear against said step, thereby wedging said wedge heart to lock said ropes in fixed position relative to each pair of wedge collars and therefore to the step between the wedge collars.

8. The rope ladder of claim 7 wherein said upper and lower wedge collars are identical.

9. The rope ladder of claim 8 wherein said wedge collars and wedge heart are of lightweight metal.

10. The rope ladder of claim 7 wherein each said wedge collar is made in two pieces that are bolted together, so that it can be assembled in said ladder directly in position without having to be threaded around the ropes from one end thereof.

11. The rope ladder of claim 10 wherein the two pieces of each said wedge collar are identical to each other, with one vertical bolt passage in each.

12. The rope ladder of claim 10 wherein said wedge collar is bolted to said two wedge collar pieces of each said lower wedge collar by a transversely extending bolt extending through said wedge heart.

* * * * *